US006774553B2

(12) United States Patent
Pyun et al.

(10) Patent No.: US 6,774,553 B2
(45) **Date of Patent: *Aug. 10, 2004**

(54) CATHODE-RAY TUBE

(75) Inventors: Do-Houn Pyun, Yongin-si (KR); Won-Sueg Park, Suwon (KR); Won-Ho Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 125 days.

This patent is subject to a terminal disclaimer.

(21) Appl. No.: 09/982,984

(22) Filed: Oct. 17, 2001

(65) Prior Publication Data

US 2002/0130609 A1 Sep. 19, 2002

Related U.S. Application Data

(63) Continuation-in-part of application No. 09/724,186, filed on Nov. 27, 2000, which is a continuation of application No. 09/058,544, filed on Apr. 10, 1998, now Pat. No. 6,160,344.

(30) Foreign Application Priority Data

Apr. 12, 1997 (KR) ..... 97-13493
Apr. 4, 1998 (KR) ..... 98-11926

(51) Int. Cl.[7] ..... H01J 61/30

(52) U.S. Cl. ..... 313/477 R; 220/2.1 A; 220/2.1 R

(58) Field of Search ..... 313/461, 473, 313/477 R; 220/2.1 A, 2.1 R, 2.3 A

(56) References Cited

U.S. PATENT DOCUMENTS

| | | | | |
|---|---|---|---|---|
| 4,537,321 A | | 8/1985 | Tokita | 313/477 R |
| 4,537,322 A | | 8/1985 | Okada et al. | 313/477 R |
| 4,580,077 A | | 4/1986 | Bakker et al. | 313/477 |
| 4,924,140 A | | 5/1990 | Hirai et al. | 313/402 |
| 5,216,321 A | | 6/1993 | Kawamura et al. | 313/479 |
| 5,814,933 A | * | 9/1998 | Iwata et al. | 313/477 R |
| 6,160,344 A | | 12/2000 | Cho et al. | 313/477 R |

FOREIGN PATENT DOCUMENTS

| | | |
|---|---|---|
| JP | 6-36710 | 2/1994 |
| JP | 6-44926 | 2/1994 |

* cited by examiner

*Primary Examiner*—Ashok Patel
(74) *Attorney, Agent, or Firm*—Christie, Parker & Hale, LLP

(57) ABSTRACT

A cathode ray tube includes a faceplate panel having a substantially flat exterior surface and a substantially concave interior surface, and a phosphor screen formed on the interior surface of the faceplate panel. The phosphor screen has a horizontal axis, a vertical axis and a diagonal axis. A length from a central portion of the phosphor screen to a point where a vertical side line of the phosphor screen intersects the horizontal axis is less than a length from the central portion of the phosphor screen to a point where the vertical side line intersects the diagonal axis.

30 Claims, 8 Drawing Sheets

CATHODE-RAY TUBE

CROSS REFERENCE TO RELATED APPLICATIONS AND PATENTS

This is a CIP of U.S. patent application Ser. No. 09/724,186 filed on Nov. 27, 2000, which is a Continuation Application of U.S. patent application Ser. No. 09/058,544, filed on Apr. 10, 1998, now U.S. Pat. No. 6,160,344, which claims priority to Korean patent application No. 1997-13493, filed on Apr. 12, 1997, and Korean patent application No. 1998-11926, filed on Apr. 4, 1998, The above-named U.S. patent applications and patent are assigned to the same entity, and are incorporated herein by reference.

BACKGROUND OF THE INVENTION (a) Field of the Invention

The present invention relates to a cathode-ray tube (CRT) having a faceplate panel, and more particularly, to a CRT faceplate panel for producing a uniform and clear visual image across the entire area of a viewing screen.

(b) Description of the Related Art

Generally, CRTs are designed to reproduce a picture image on a screen of a faceplate panel by exciting phosphors coated on an interior surface of the faceplate panel with electron beams emitted from an electron gun and passing through apertures of a color-selecting shadow mask. The shadow mask ensures that each electron beam lands on the correct phosphor.

The faceplate panel is usually formed with a transparent glass plate having curved interior and exterior surfaces. These curved surfaces enable the panel to withstand the high-vacuum in the CRT and facilitate the landing of the electron beams on the phosphor screen.

However, such a faceplate panel involves a relatively broad light-reflecting exterior area in peripheral portions, thereby deteriorating the brightness of those areas and distorting the appearance of the picture.

To remedy this problem, a glass plate having flat interior and exterior surfaces has been developed to be used for the CRT panel. Such a panel employs a flat tension mask to perform the color-selecting function, the flat tension mask corresponding to the flat interior surface of the panel. The flat tension mask has predetermined horizontal and vertical tensional strengths to prevent the occurrence of a doming phenomenon.

However, in this type of panel, the visual images realized through the phosphor screen and refracted on the panel appear depressed to the user in the center portion of the viewing screen. The problem becomes more severe with larger-sized screens.

To overcome this drawback, Japanese Patent Laid-Open Publication Nos. H6-44926 and 6-36710 introduce a CRT faceplate panel, which is flat on an exterior surface but curved on an interior surface. However, the images realized through these inventions appear bulged outward. Further, because the peripheral portions of the panel are considerably thicker than the center portions, the brightness of the screen is deteriorated.

SUMMARY OF THE INVENTION

It is an object of an embodiment of the present invention to provide a CRT faceplate panel for producing a uniform visual image across the entire area of a viewing screen.

It is another object of an embodiment of the present invention to provide a CRT faceplate panel having an optimum light transmission rate to realize a clear visual image across the viewing screen.

It is still another object of an embodiment of the present invention to provide a CRT having a faceplate panel for producing a clear visual image across the viewing screen.

In order to achieve these objects and others, an embodiment of the CRT faceplate panel includes a faceplate panel having a substantially flat exterior surface and a substantially concave interior surface, and a phosphor screen formed on the interior surface of the faceplate panel. The phosphor screen has a horizontal axis, a vertical axis and a diagonal axis. A length from a central portion of the phosphor screen to a point where a vertical side line of the phosphor screen intersects the horizontal axis is less than a length from the central portion of the phosphor screen to a point where the vertical side line intersects the diagonal axis.

The faceplate panel comprises an effective screen corresponding to the phosphor screen. That is, the effective screen comprises a horizontal axis, a vertical axis and a diagonal axis, wherein a length from a central portion of the effective screen to a point where a vertical side line of the effective screen intersects the horizontal axis is less than a length from the central portion of the effective screen to a point where the vertical side line intersects the diagonal axis.

The cathode ray tube further comprises a shadow mask placed behind the faceplate panel, the shadow mask having an effective electron beam-passing area on which a plurality of apertures are formed, in which the effective beam-passing area of the shadow mask comprises a horizontal axis Hs, a vertical axis Vs and a diagonal axis Ds, wherein a length Hsd from a central portion of the effective beam-passing area to a point where the vertical side line of the effective beam-passing area intersects the horizontal axis Hs is less than a length from the central portion of the effective beam-passing area to a point where the vertical side line of the effective beam-passing area intersects the diagonal axis Ds.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Reference will now be made in detail to the preferred embodiment of the present invention, examples of which are illustrated in the accompanying drawings.

Figure 1:
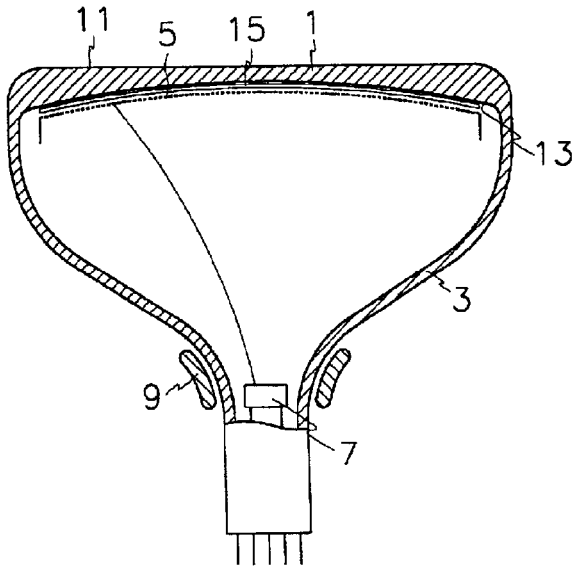
FIG. 1 is a partial sectional view of a CRT according to a preferred embodiment of the present invention.

FIG. 1 is a partial sectional view of a CRT according to a preferred embodiment of the present invention. As shown in FIG. 1, the inventive CRT includes a faceplate panel 1 having a phosphor screen 15, a funnel 3 sealed to the rear of the panel 1, a shadow mask 5 behind the panel 1 with the phosphor screen 15 interposed therebetween, an electron gun 7 mounted within the neck of the funnel 3, and a deflection yoke 9 placed around the outer periphery of the funnel 3. In such a CRT, visual images are produced by exciting phosphors on the phosphor screen 15 with electron beams emitted from the electron gun 7 and passing through the shadow mask 5, the shadow mask 5 performing a color-selecting function.

The panel 1 has a flat exterior surface 11 to minimize reflection of external light and produce clear visual images even on the peripheral edges of the viewing screen. In contrast, the interior surface 13 of the panel 1 is concave. That is, the interior surface 13 of the panel 1 is curved in a direction toward the flat exterior surface 11. This curved interior surface 13 is an essential feature of an embodiment of the present invention for producing a uniform visual image across the entire area of the viewing screen.

The shadow mask 5 has a curvature corresponding to the interior surface 13 of the panel 1. The inventive shadow mask 5 is formed using a pressing process. Accordingly, manufacture of the inventive shadow mask 5 is considerably easier and less costly than the flat tension mask used in the prior art CRT.

Figure 2:
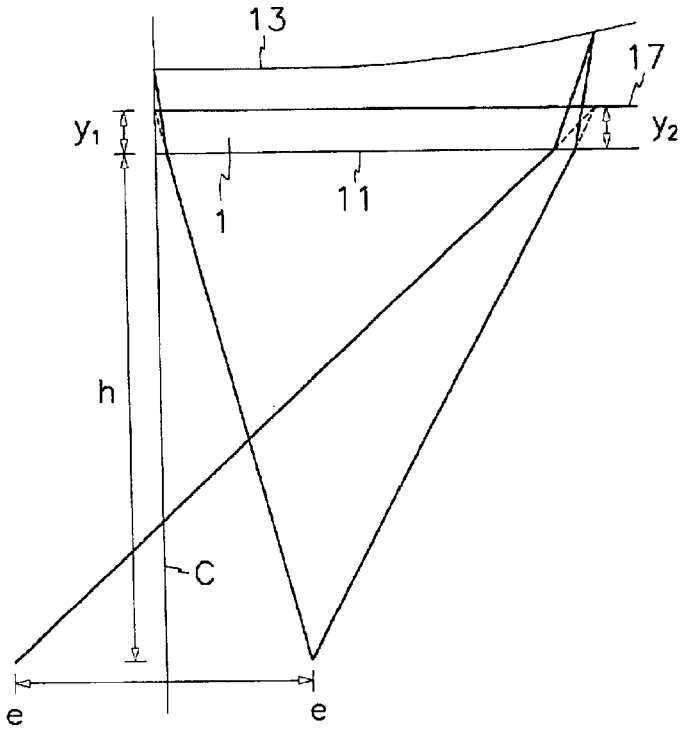
FIG. 2 is a diagram illustrating a visual image with respect to an interior surface of a panel depicted in FIG. 1.

Referring now to FIG. 2, shown is a diagram illustrating the relation between a visual image and the interior surface 13 of the panel 1. In the drawing, when the distance between the user and the exterior surface 11 is determined to be equal to the horizontal width h of the effective screen, the curved interior surface 13 should be set to satisfy the following mathematical formula 1. This prevents the phenomenon in which the effective screen appears to have a concave shape to the user, and results in a uniform visual image.

Referring to FIG. 2, $$y_1-y_2 \leq 0 \tag{1}$$

where $y_1$ is the distance between the exterior surface 11 and a visual image line 17 on a central axis of the faceplate panel 1, and $y_2$ is the distance between the exterior surface 11 and the visual image line 17 at the periphery of the faceplate panel 1. In the above formula, $y_1-y_2$ can be regarded as a measure of the degree of uniformity of the visual image.

The above effective screen is an imaginary plane on the exterior surface 11 when the phosphor screen 15 is vertically projected thereon. The reason that the distance between the user and the exterior surface 11 is determined to be the horizontal width h of the effective screen is because the relation between the viewing angle and uniformity of the visual image can be properly judged from that distance.

Figure 3:
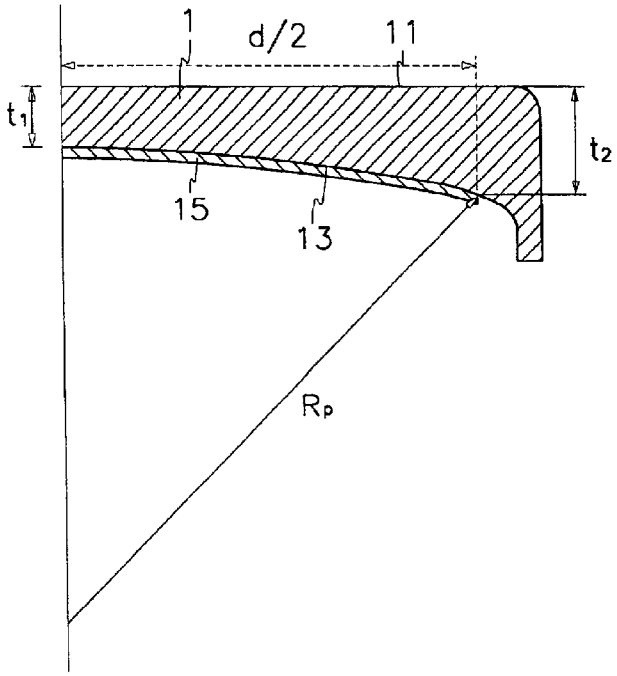
FIG. 3 is a partial sectional view illustrating a curvature radius of an interior surface of a panel depicted in FIG. 1.

FIG. 3 is a schematic diagram illustrating the relation between the curvature radius Rp of the interior surface 13 and the thicknesses $t_1$ and $t_2$ of the panel 1. Namely, $t_1$ indicates the thickness of the central portion of the panel 1 while $t_2$ indicates the thickness of the peripheral portion of the panel 1 at the diagonal corner of the effective screen. Because of the curvature of the interior surface 13, $t_2$ is greater than $t_1$.

The unit value R of the curvature radius Rp is given by the following mathematical formula 2:

$$R=1.767\times d, \tag{2}$$

where d is the diagonal width of the effective screen. The above formula is derived from the published Technical Papers of the SID International Symposium in 1992 by Matsushita Corporation, Japan. The unit curvature radius R varies depending upon the employed panel type.

Figure 4:
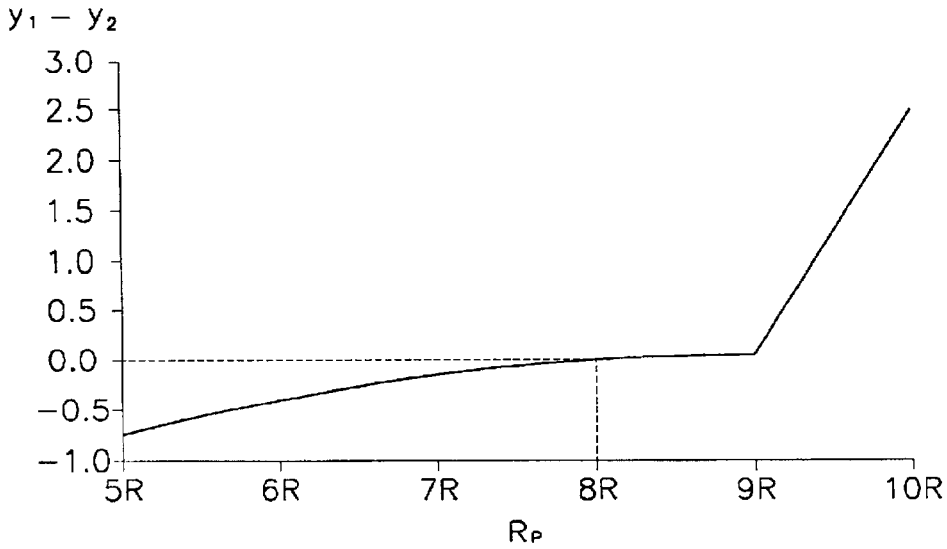
FIG. 4 is a graph illustrating a uniformity of a visual image with respect to the curvature radius of an interior surface of a panel depicted in FIG. 1.

FIG. 4 is a graph illustrating the relation between the uniformity $y_1-y_2$ of the visual image and the curvature radius Rp of the interior surface 13 in a 17-inch CRT. As shown in the drawing, the mathematical formula 1 is satisfied in the range of 8R or less. This means that a uniform visual image can be obtained in the range of 8R or less. However, in a range exceeding 8R, the visual image appears to be depressed in the center of the viewing screen. This relation is also applicable to other type CRTs. Therefore, in this preferred embodiment, the curvature radius $R_P$ of the interior surface 13 of the panel 1 is determined to be in the range of 8R or less.

The resulting large thickness of the peripheral portion of the panel 1, however, acts to deteriorate brightness. Thus, in order to overcome such an undesirable effect, the ratio of light transmission at the periphery of the effective screen to light transmission at the center of the effective screen should be relatively high. As a result, in this preferred embodiment, the desired ratio of light transmission at the peripheral portion at the diagonal corner of the effective screen to light transmission at the center of the effective screen is determined to be 0.85 or greater. This value is adopted in consideration of the correlation among the panel weight, production cost and productivity.

Accordingly, a clear glass having a central light transmission rate of 85% or more can be used for the panel 1.

Measurement of the central light transmission rate of the clear glass panel is conducted using the following mathematical formula 3:

$$\text{Light Transmission Rate } (\%)=(e^{-\alpha t}-0.08)\times 100, \tag{3}$$

where $\alpha=0.006090$ and t is the central thickness of the panel.

Figure 5:
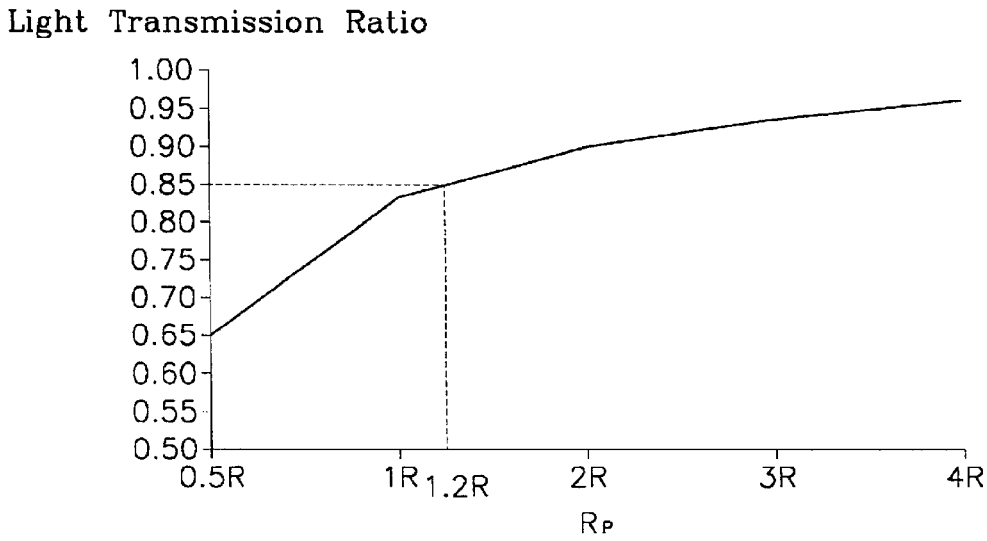
FIG. 5 is a graph illustrating a light transmission ratio at the center and periphery of a panel with respect to a curvature radius of an interior surface of a panel depicted in FIG. 1.

FIG. 5 is a graph illustrating the relation between the curvature radius Rp and the ratio of light transmission at the peripheral portion at the diagonal corner of the effective screen to the light transmission at the center of the effective screen. As shown in FIG. 5, when the desired light transmission ratio is determined to be 0.85 or greater, the curvature radius $R_p$ needed becomes 1.2R or more. Conversely, with a curvature radius $R_P$ of 1.2R or more, the light transmission ratio becomes 0.85 or greater, thereby producing good brightness. However, with a curvature radius $R_p$ of less than 1.2R, the light transmission ratio becomes less than 0.85 such that brightness is deteriorated.

Therefore, referring to FIGS. 4 and 5, the curvature radius $R_p$ of the interior surface 13 of the panel 1 according to a preferred embodiment of the present invention satisfies the following mathematical formula 4:

$$1.2R \leqq R_P \leqq 8R \quad (4)$$

where R=1.767×the diagonal width of the effective screen of the CRT.

When the curvature radius $R_P$ is in the above range, the phenomenon in which the visual image appears to be depressed in the center of the viewing screen can be prevented, such that good brightness can be obtained.

Panel types capable of satisfying the mathematical formula 4 are listed in Table 1.

TABLE 1

| | C(mm) | A(mm) | B(mm) |
|---|---|---|---|
| 15 inch | 10.5 | 34.7 | 13.65 |
| 17 inch | 11.5 | 35.7 | 15.10 |
| 19 inch | 12.0 | 36.2 | 16.03 |
| 25 inch | 13.0 | 37.2 | 18.22 |
| 29 inch | 14.0 | 38.2 | 20.00 |
| 32 inch | 15.0 | 39.2 | 21.74 |

where C is the central thickness t of the panel 1, A is the peripheral thickness t2 of the panel 1 at the diagonal corner of the effective screen when the light transmission ratio is 0.85, and B is the peripheral thickness t2 of the panel 1 when the curvature radius $R_P$ is 8R.

Referring to Table 1, the peripheral thickness t2 of the panel 1 at the end of the effective screen can be determined using the following mathematical formula 5. This range is given considering the correlation among the factors of thickness, light transmission ratio, and curvature radius.

Referring to Table 1:

$$B \leqq t_2 \leqq A \quad (5)$$

In the 17-inch panel, the thickness t2 can be derived from mathematical formula 5 and Table 1 as 15.10 mm$\leqq t_2 \leqq$35.7 mm.

Figure 7:
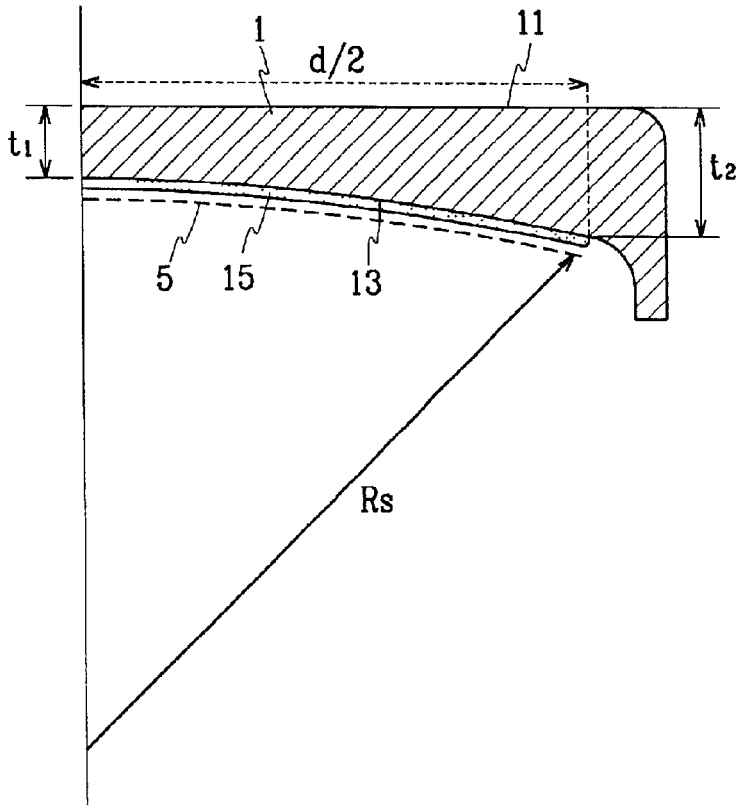
FIG. 7 is a partial sectional view illustrating a curvature radius of a shadow mask depicted in FIG. 1.

In addition, the range of curvature radius $R_P$ defined in mathematical formula 4 can be further limited in view of the characteristics of the shadow mask 5. The shadow mask 5 should have a curvature radius $R_S$ identical with or smaller than the curvature radius $R_P$ of the interior surface 13 of the panel 1 (see FIG. 7). However, when the shadow mask 5 is formed with a curvature radius of more than 4R, it is possible for the shadow mask 5 to become distorted.

Thus, the shadow mask 5 should have a curvature radius $R_S$ capable of satisfying the following mathematical formula 6, while the curvature radius $R_P$ of the panel 1 defined in the mathematical formula 4 should be limited by the following mathematical formula 7:

$$1.2R \leqq R_S \leqq 4R \quad (6)$$

$$1.2R \leqq R_P \leqq 4R \quad (7)$$

Figure 6:
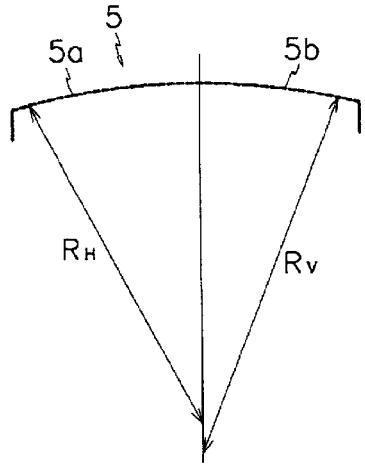
FIG. 6 is a diagram illustrating a horizontal curvature radius and a vertical curvature radius of a shadow mask depicted in FIG. 1.

FIG. 6 is a schematic diagram illustrating a horizontal curvature radius and a vertical curvature radius of the shadow mask 5. In order to minimize the occurrence of the doming phenomenon, it is preferable that the horizontal curvature radius $R_H$ of the shadow mask 5 as shown in FIG. 6 be identical with or smaller than the vertical curvature radius $R_V$. That is, the shadow mask 5 should satisfy the following mathematical formula 8:

$$R_H \leqq R_V \quad (8)$$

When the curvature radius $R_P$ is defined by the mathematical formula 7, B in Table 1 is changed into $B^1$ in Table 2.

TABLE 2

| | 15 inch | 17 inch | 19 inch | 25 inch | 29 inch | 32 inch |
|---|---|---|---|---|---|---|
| B'(mm) | 16.8 | 18.7 | 20.7 | 23.45 | 25.97 | 28.49 |

where B' is the peripheral thickness t2 of the panel 1 at the diagonal corner of the effective screen when the curvature radius $R_P$ is 4R.

Therefore, mathematical formula 5 can also be changed into mathematical formula 9:

$$B' \leqq t_2 \leqq A \quad (9)$$

Therefore, in the 17-inch panel, the thickness $t_2$ can be derived from mathematical formula 8 and Table 2 as 18.7 mm$\leqq t_2 \leqq$35.7 mm.

As described above, in the inventive CRT faceplate panel, the curvature radius $R_P$ of the interior surface 13 of the panel 1 is in the range of $1.2R \leqq R_P \leqq 8R$ so that the visual image appears uniformly and clearly across the entire area of the viewing screen.

FIGS. 8 to 13 illustrate a cathode ray tube relating to another preferred embodiment of the present invention.

Figure 8:
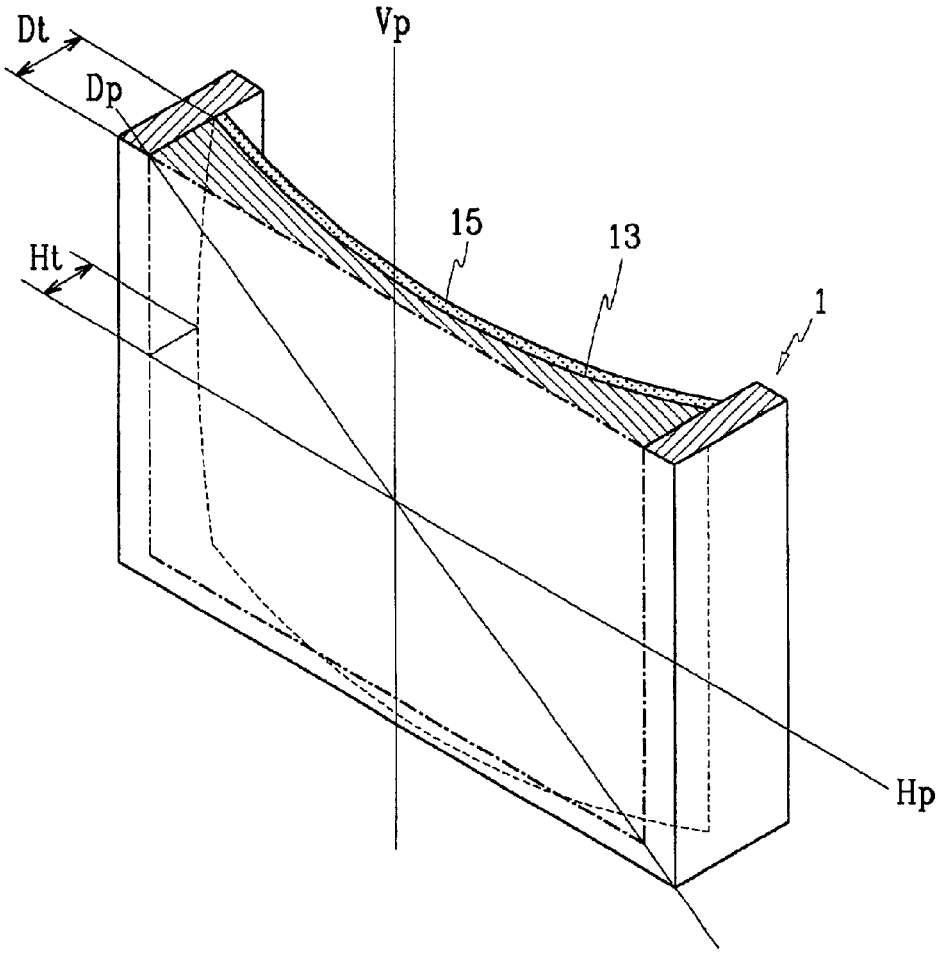
FIG. 8 is a perspective view illustrating a relation between a phosphor screen and an effective screen of a conventional cathode ray tube.

Referring first to FIG. 8, when a panel 1 is designed having a flat exterior surface and a curved interior surface 13, and a phosphor screen 15 is formed on the curved interior surface 13, an effective screen is formed in a rectangular shape (see a dot-broken line in FIG. 8).

Figure 9:
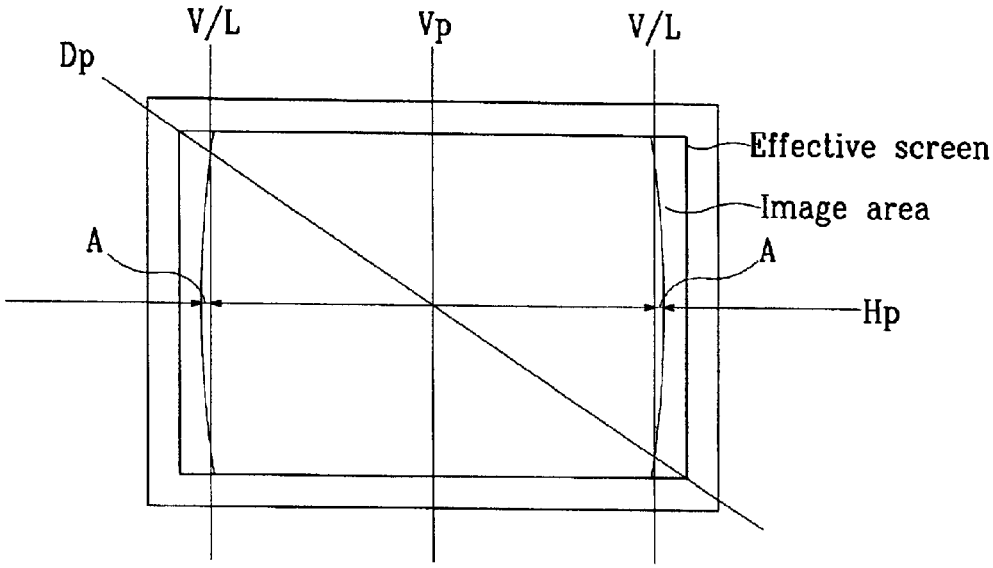
FIGS. 9 and 10 are diagrams illustrating a relation between an effective screen and an image area of a conventional cathode ray tube.

Normally, when an image is realized on the panel 1 in accordance with the operation of the CRT, the image should be viewed in a rectangular shape in response to the rectangular effective screen. That is, the image should be projected to be flat in a user's view on a central line of the panel 1. However, as shown in FIG. 9, an actual image realized in the vicinity of both side ends of the panel 1 is not viewed in a rectangular shape but in a convex shape curved toward both side ends of the panel 1 since a thickness Ht at the side ends on a horizontal axis Hp of the panel 1 is different from a thickness Dt at the side ends on a diagonal axis Dp. That is, the image realized on the image area is barrel-shaped.

Figure 10:
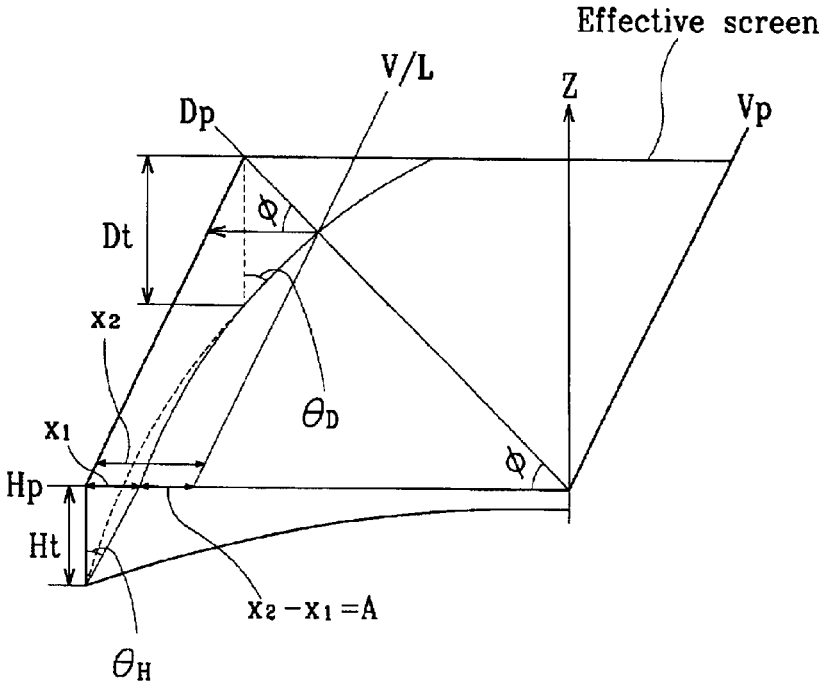

At this point, the convex image has a maximum convex distance A from a vertical line V/L defining a rectangular image area on the horizontal axis Hp. Here, the maximum convex distance A can be calculated according to the following equation.

$$A = X2 - X1$$

where X1 is a horizontal width from a horizontal effective screen end of the panel 1 to a horizontal image area end on the horizontal axis Hp of the panel 1, and X2 is a horizontal width from the horizontal effective screen end of the panel 1 to a horizontal image area end on a diagonal axis Dp of the panel 1. Referring to FIG. 10, the X1 and X2 can be geometrically calculated according to the following equations.

$$X1 = Ht \times \tan\theta_H$$

$$X2 = Dt \times \tan\theta_D \times \cos\phi$$

Accordingly, the present invention is provided to prevent the flatness of the entire image realized in the image area from being deteriorated.

Figure 11:
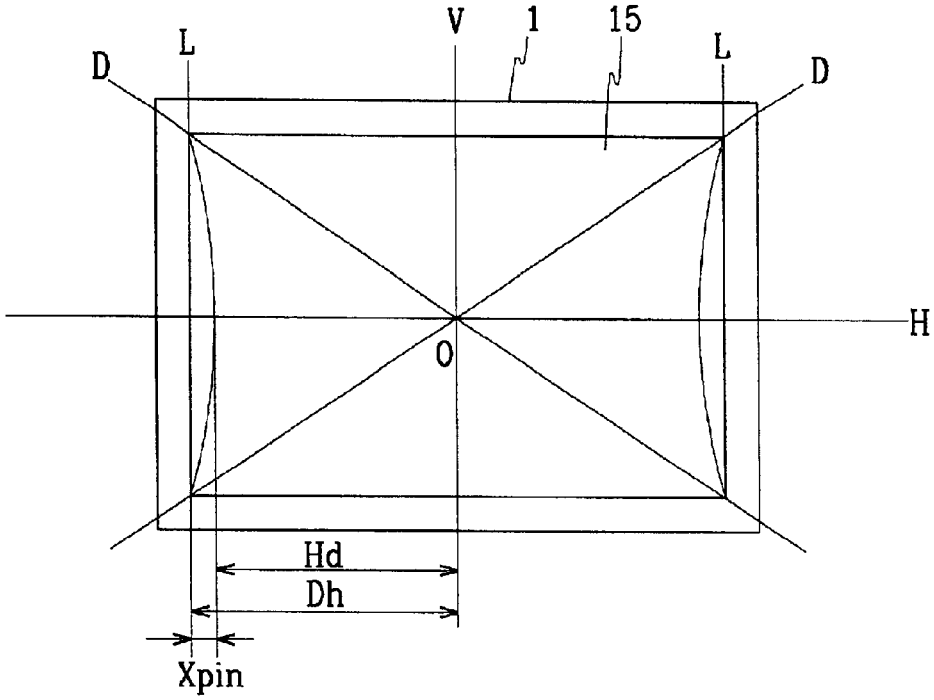
FIG. 11 is a diagram illustrating a phosphor screen according to a preferred embodiment of the present invention.

To achieve this, as shown in FIG. 11, the phosphor screen 15 having a horizontal axis H, a vertical axis V, and a diagonal axis D is formed such that both vertical side lines thereof have a concave pincushion shape. As shown, the horizontal axis H, the vertical axis V, and the diagonal axis D go through a central portion O of the phosphor screen 15. In this configuration, a length Hd from the central portion O of the phosphor screen 15 to a point on which the vertical side line of the phosphor screen 15 intersects the horizontal axis H is less than a shortest distance (hereinafter refered to as length) Dh from the vertical axis V of the phosphor screen 15 to a point where the vertical side line of the phosphor screen is intersects the diagonal axis D. Accordingly, an effective screen defined on the panel is formed corresponding to the shape of the phosphor screen 15. The effective screen has a central portion O', a horizontal axis H', a vertical axis V', and a diagonal axis D' as shown in FIG. 12.

When the phosphor screen 15 is formed in the concave pincushion shape, there is a gap Xpin from a point where the horizontal axis H intersects the vertical side line of the phosphor screen 15 to a point where the horizontal axis H of the phosphor screen 15 intersects a vertical line L vertically connecting a point where the diagonal axis intersects the vertical side line of the phosphor screen 15 to a point on the horizontal axis H. Accordingly, when both vertical side lines of the phosphor screen 15 are formed to be concave by as much as the gap Xpin, the convex image can be corrected.

Figure 12:
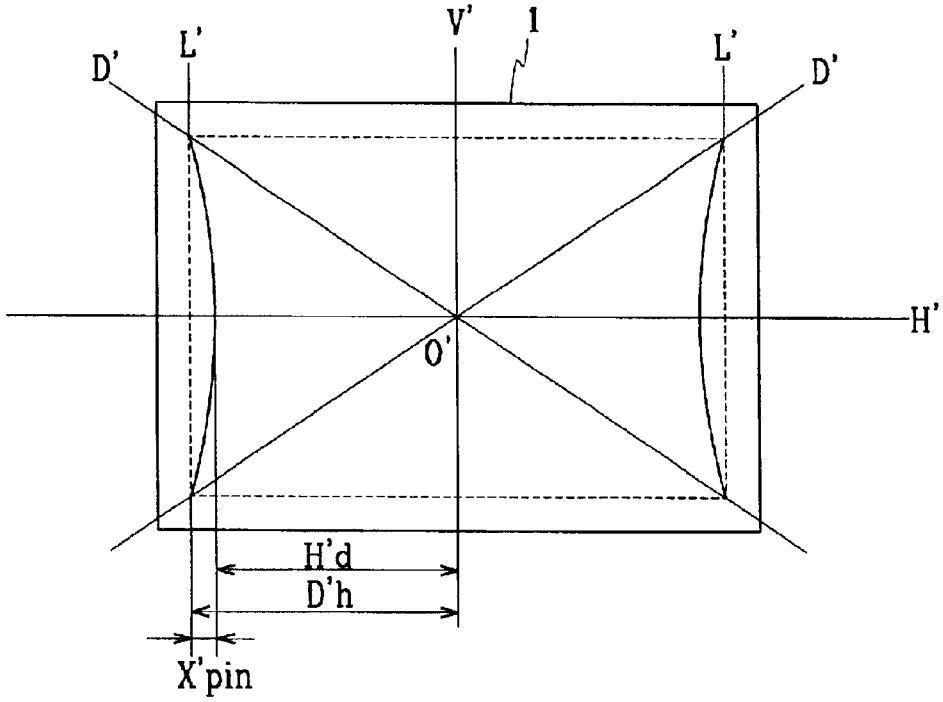
FIG. 12 is a diagram illustrating an effective screen according to a preferred embodiment of the present invention.

Here, a value of the gap Xpin approximates a maximum convex distance A (X2−X1) so that "Xpin−A" approximates "0." The gap Xpin is represented as X'pin in the effective screen (see FIG. 12).

The gaps Xpin according to CRTs having different diagonal widths and thicknesses are listed in Table 3.

TABLE 3

| No | Hd (mm) | Dd (mm) | Ct (mm) | Ht (mm) | Dt (mm) | θa (°) | X2−X1 (mm) | Xpin (mm) | Xpin/Hd (%) |
|---|---|---|---|---|---|---|---|---|---|
| 1 | 162.55 | 203.2 | 11.5 | 17.2 | 20.5 | 38.6 | 0.9 | 1.1 | 0.55 |
| 2 | 162.55 | 203.2 | 11.5 | 19.2 | 23.5 | 36.6 | 1.4 | 1.57 | 0.86 |
| 3 | 162.55 | 203.2 | 11.5 | 21.7 | 27.5 | 42.2 | 2.0 | 2.3 | 1.23 |
| 4 | 182.9 | 228.6 | 12.5 | 19.5 | 23.5 | 38.6 | 1.2 | 1.4 | 0.65 |
| 5 | 182.9 | 228.6 | 12.5 | 22.5 | 28.2 | 40.1 | 1.9 | 2.1 | 1.03 |
| 6 | 182.9 | 228.6 | 12.5 | 25.6 | 33.2 | 46 | 2.7 | 3.1 | 1.48 |

In Table 3, θa indicates a light incidental angle from a side line of the effective screen to a central axis of the screen.

In addition, Nos. 1–3 show data of CRTs each having an effective diagonal width (2×Hd) of 404.6 mm, and Nos. 4–6 show data of CRTs each having an effective diagonal width (2×Hd) of 457.2 mm.

As shown in Table 3, the length of the gap Xpin is similar to that of the maximum convex distance A (X2−X1). Accordingly, if the following condition is satisfied, the actual image is not realized in the barrel shape but in the flattened rectangular shape.

$$0.5\% \leqq (X\text{pin}/Hd) \times 100 \leqq 1.5\%$$

That is, when the values of the gap Xpin and the length Hd are set not to satisfy the above condition, for example, when Xpin/Hd is less than 0.5, it is difficult to realize the flattened rectangular shape of the actual image. In addition, when Xpin/Hd is greater than 1.5, the actual image is shown to be concave toward the central portion of the panel 1 when it is viewed from a peripheral portion of the panel 1.

Figure 13:
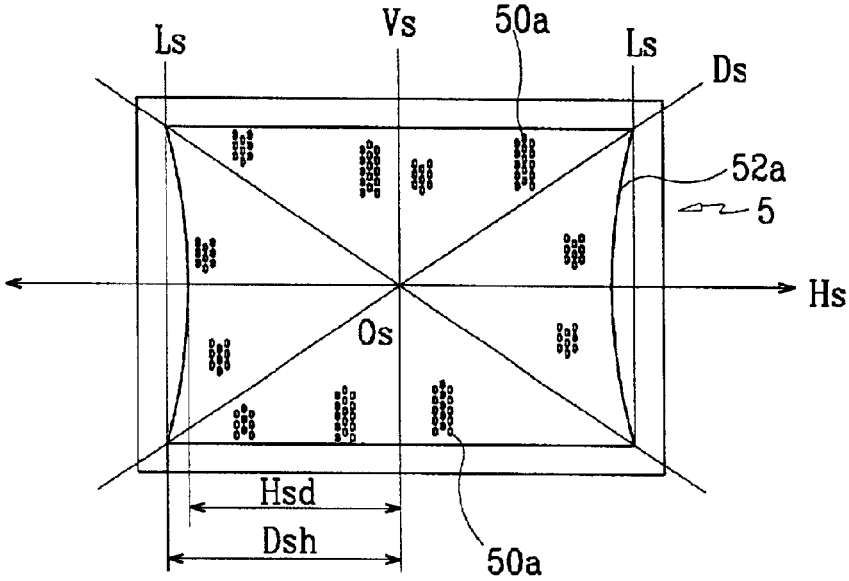
FIG. 13 is a diagram illustrating a shadow mask according to a preferred embodiment of the present invention.

When the phosphor screen 15 is formed according to the above-described embodiment, as shown in FIG. 13, the shadow mask 5 is preferably designed in accordance with the shape of the phosphor screen 15. That is, it is preferable that an effective area 52*a* on which electron beam-passing apertures 50*a* are formed correspond to the shape of the phosphor screen 15.

That is, in the effective area 52*a* having a horizontal axis Hs, a vertical axis Vs and a diagonal axis Ds, a length Hsd from a central portion Os of the effective area 52*a* to a point where the vertical side line of the effective area 52*a* intersects the horizontal axis Hs is less than a length Dsh from the central portion Os of the effective area 52*a* to a point where the vertical side line of the effective area 52*a* intersects the diagonal axis Ds.

At this point, the curvature radius of the shadow mask 15 is designed to satisfy the above-described conditions.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A cathode ray tube comprising:

a faceplate panel having a substantially flat exterior surface and a substantially concave interior surface; and a phosphor screen on the interior surface of the faceplate panel, the phosphor screen having a horizontal axis, a vertical axis and a diagonal axis;

wherein the horizontal axis, the vertical axis, and the diagonal axis go through a central portion of the phosphor screen and a length from the central portion of the phosphor screen to a point where a vertical side line of the phosphor screen intersects the horizontal axis is less than a length of a shortest distance from the vertical axis of the phosphor screen to a point where the vertical side line intersects the diagonal axis.

2. A cathode ray tube of claim 1 satisfying the following conditions:

$$0.5\% \leqq (X\text{pin}/Hd) \times 100 \leqq 1.5\%$$

where Xpin is a gap from a point where the horizontal axis intersects the vertical side line of the phosphor screen to a point where the horizontal axis of the phosphor screen intersects a line vertically connecting a point where the diagonal axis intersects the vertical side line of the phosphor screen to a point on the horizontal axis, and Hd is the length from the central portion of the phosphor screen to the point where the vertical side line of the phosphor screen intersects the horizontal axis.

3. A cathode ray tube of claim 2 wherein the concave interior surface has a curvature radius $R_p$ satisfying the following condition:

$$1.2R \leqq R_p \leqq 8R$$

where R=1.767×a diagonal width of an effective screen of the cathode ray tube.

4. A cathode ray tube of claim 3 wherein the curvature radius $R_p$ is identical to a diagonal curvature radius of the diagonal axis of the phosphor screen.

5. A cathode ray tube of claim 1 wherein a light transmissivity at a central portion of the panel is 85% or greater.

6. A cathode ray tube of claim 1 wherein a ratio of light transmission at a peripheral portion on a diagonal corner of an effective screen of the cathode ray tube to light transmission at a central portion of the effective screen is 0.85 or greater.

7. A cathode ray tube of claim 6 wherein a light transmissivity at the central portion of the panel is 85% or greater.

8. A cathode ray tube of claim 1 wherein the faceplate panel satisfies the following condition:

$$y_1-y_2\leqq 0$$

where $y_1$ is a distance between the exterior surface and a visual image on a central axis of the faceplate panel and $y_2$ is a distance between the exterior surface and a visual image on a periphery of the faceplate panel.

9. A cathode ray tube comprising:

a faceplate panel having a substantially flat exterior surface and a substantially concave interior surface; and a phosphor screen on the interior surface of the faceplate panel, the phosphor screen having a horizontal axis, a vertical axis and a diagonal axis, wherein the faceplate panel comprises an effective screen corresponding to the phosphor screen, the effective screen comprising a horizontal axis, a vertical axis and a diagonal axis, wherein the horizontal axis, the vertical axis, and the diagonal axis go through a central portion of the effective screen, and a length from the central portion of the effective screen to a point where a vertical side line of the effective screen intersects the horizontal axis is less than a length of a shortest distance from the vertical axis of the effective screen to a point where the vertical side line intersects the diagonal axis.

10. A cathode ray tube of claim 9 satisfying the following conditions:

$$0.5\%\leqq(X'\text{pin}/H'\text{d})\times 100\leqq 1.5\%$$

where X'pin is a gap from a point where the horizontal axis intersects the vertical side line of the effective screen to a point where the horizontal axis of the effective screen intersects a line vertically connecting a point where the diagonal axis intersects the vertical side line of the effective screen to a point on the horizontal axis, and Hd is the length from the central portion of the effective screen to the point where the vertical side line of the effective screen intersects the horizontal axis.

11. A cathode ray tube of claim 9 wherein the concave interior surface has a curvature radius $R_p$ satisfying the following condition:

$$1.2R\leqq R_p\leqq 8R$$

where R=1.767×a diagonal width of the effective screen of the cathode ray tube.

12. A cathode ray tube of claim 11 wherein the curvature radius $R_p$ is identical to a diagonal curvature radius of the diagonal axis of the phosphor screen.

13. A cathode ray tube of claim 9 wherein a light transmissivity at a central portion of the panel is 85% or greater.

14. A cathode ray tube of claim 9 wherein a ratio of light transmission at a peripheral portion on a diagonal end of the phosphor screen to light transmission at a central portion of the effective screen is 0.85 or greater.

15. A cathode ray tube of claim 14 wherein a light transmissivity at the central portion of the panel is 85% or greater.

16. A cathode ray tube of claim 9 wherein the faceplate panel satisfies the following condition:

$$y_1-y_2\leqq 0$$

where $y_1$ is a distance between the exterior surface and a visual image on a central axis of the faceplate panel and $y_2$ is a distance between the exterior surface and a visual image on a periphery of the faceplate panel.

17. A cathode ray tube of claim 9 wherein a diagonal end of the effective screen of the cathode ray tube satisfies the following condition:

$$B\leqq t_1\leqq A$$

where B is a peripheral thickness of the faceplate panel on the diagonal end of the effective screen when a curvature radius $R_p$ of the concave interior surface is 8R, where R=1.767×a diagonal width of the effective screen, and A is a peripheral thickness of the faceplate panel on the diagonal end of the effective screen when a ratio of light transmission at a peripheral portion of the faceplate panel on the diagonal end of the effective screen to light transmission at the central portion of the effective screen is 0.85.

18. A cathode ray tube of claim 17 wherein the curvature radius $R_p$ is identical to a diagonal curvature radius of the diagonal axis of the effective screen.

19. A cathode ray tube comprising:

a faceplate panel comprising a substantially flat exterior surface and a substantially concave interior surface;

a phosphor screen on the concave interior surface of the faceplate panel;

a funnel sealed to the faceplate panel;

a shadow mask having an effective electron beam-passing area comprising a plurality of apertures;

an electron gun mounted in a neck portion of the funnel; and a deflection yoke around an outer periphery of the funnel;

wherein the faceplate panel comprises an effective screen corresponding to the phosphor screen, the effective screen comprising a horizontal axis, a vertical axis and a diagonal axis, wherein the horizontal axis, the vertical axis, and the diagonal axis go through a central portion of the effective screen, and a length from the central portion of the effective screen to a point where a vertical side line of the effective screen intersects the horizontal axis is less than a length of a shortest distance from the vertical axis of the effective screen to a point where the vertical side line intersects the diagonal axis; and wherein the effective beam-passing area of the shadow mask comprises a horizontal axis Hs, a vertical axis Vs and a diagonal axis Ds, wherein a length Hsd from a central portion of the effective beam-passing area to a point where a vertical side line of the effective beam-passing area intersects the horizontal axis Hs is less than a length from the central portion of the effective beam-passing area to a point where the vertical side line of the effective beam-passing area intersects the diagonal axis Ds.

20. A cathode ray tube of claim 19 wherein the concave interior surface has a curvature radius $R_p$ satisfying the following condition:

$$1.2R\leqq R_p\leqq 8\text{R}$$

where R=1.767×a diagonal width of the effective screen.

21. A cathode ray tube of claim 20 wherein the curvature radius $R_p$ is identical to a diagonal curvature radius of the diagonal axis of the effective screen.

22. A cathode ray tube of claim 19 wherein the shadow mask is curved in at least one direction.

23. A cathode ray tube of claim 22 wherein the shadow mask has a curvature radius $R_s$ satisfying the following condition:

$$1.2R \leqq R_p \leqq 8R$$

where R=1.767×a diagonal width of the effective screen.

24. A cathode ray tube of claim 23 wherein the curvature radius $R_s$ is identical to a diagonal curvature radius of the diagonal axis of the effective screen.

25. A cathode ray tube of claim 19 wherein a light transmissivity at the central portion of the panel is 85% or greater.

26. A cathode ray tube of claim 19 wherein a ratio of light transmission at a peripheral portion on a diagonal end of the effective screen to light transmission at a central portion of the effective is 0.85 or greater.

27. A cathode ray tube of claim 26 wherein a light transmissivity at a central portion of the panel is 85% or greater.

28. A cathode ray tube of claim 19 wherein the faceplate panel satisfies the following condition:

$$y1-y2 \leqq 0$$

where $y_1$ is a distance between the exterior surface and a visual image on a central axis of the faceplate panel and $y_2$ is a distance between the exterior surface and a visual image on a periphery of the faceplate panel.

29. A cathode ray tube of claim 22 wherein a curvature radius of the shadow mask is identical to or less than a curvature radius of the concave interior surface of the faceplate panel.

30. A cathode ray tube of claim 22 wherein a horizontal curvature radius of the shadow mask is identical to or less than a vertical curvature radius of the shadow mask.

* * * * *